US007445166B2

(12) United States Patent
Williams

(10) Patent No.: US 7,445,166 B2
(45) Date of Patent: Nov. 4, 2008

(54) ADJUSTABLE SOLID-FLOW NOZZLE AND METHOD

(76) Inventor: Jeffrey Marc Williams, 8011 Robinson Church Rd., Charlotte, NC (US) 28215

( * ) Notice: Subject to any disclaimer, the term of this patent is extended or adjusted under 35 U.S.C. 154(b) by 0 days.

(21) Appl. No.: 11/123,967

(22) Filed: May 6, 2005

(65) Prior Publication Data

US 2005/0258275 A1 Nov. 24, 2005

Related U.S. Application Data

(60) Provisional application No. 60/568,948, filed on May 7, 2004.

(51) Int. Cl.
*B05B 1/26* (2006.01)
*B05B 15/00* (2006.01)

(52) U.S. Cl. ..... 239/503; 239/502; 239/519; 239/522; 239/546; 239/DIG. 12

(58) Field of Classification Search ..... 239/458, 239/460, 457, 464, 487, 489, 498, 499, 502, 239/503, 504, 513, 506, 533.13, 521, 522, 239/519, 514, 516, 517, 456, 482, 483–485, 239/491, 539, 538, 541, 591, 455, 492, 546, 239/DIG. 12

See application file for complete search history.

(56) References Cited

U.S. PATENT DOCUMENTS 58,606 A * 10/1866 Coolidge ..... 239/455
157,526 A * 12/1874 Leggett ..... 239/455
157,527 A * 12/1874 Leggett ..... 239/455
351,968 A 11/1886 Derrick
733,618 A * 7/1903 Brachhausen ..... 138/45
930,095 A 8/1909 Seagrave
1,865,012 A 6/1932 Jackson
2,083,282 A 6/1937 Thompson
2,585,509 A 2/1952 Smith
2,595,737 A * 5/1952 Von Rotz ..... 417/189
3,776,470 A 12/1973 Tsuchiya
5,261,494 A 11/1993 McLoughlin et al.
5,497,946 A 3/1996 Laidler

* cited by examiner

*Primary Examiner*—Christopher S Kim
(74) *Attorney, Agent, or Firm*—Moore & VanAllen PLLC; Henry B. Ward, III

(57) ABSTRACT

Adjustable nozzles for directing a solid-stream of fluid and associated methods for using the same are provided. According to one embodiment, the adjustable nozzle includes a base member having an aperture therethrough defining a nozzle inlet. The nozzle includes a plurality of elongate vanes each having first and second ends. The first ends of the vanes extend from the base member in a circumferential configuration so as to form an interior region. The second ends of the vanes are operable to define an expandable nozzle outlet. The nozzle includes a liner extending from the nozzle inlet to the nozzle outlet within the interior region. The liner is structured to direct the fluid from the nozzle inlet to the nozzle outlet. Each of the plurality of vanes is biased towards the liner to thereby support the liner and control the flow of the fluid therethrough.

14 Claims, 8 Drawing Sheets

ADJUSTABLE SOLID-FLOW NOZZLE AND METHOD

CROSS-REFERENCE TO RELATED APPLICATION

The present application claims priority from U.S. Provisional Application No. 60/568,948 entitled "Adjustable Solid-Flow Nozzle and Method" filed May 7, 2004, the contents of which are incorporated herein by reference.

BACKGROUND OF THE INVENTION

1. Field of the Invention

The present invention relates generally to nozzles and methods for adjusting a nozzle and, more particularly, to adjustable nozzles for directing a solid-stream of fluid and methods for using the same.

2. Description of Related Art

In order to adequately extinguish fires, nozzles must be capable of adjusting the water stream pattern quickly and efficiently to respond to particular circumstances. Generally, fire hoses may be equipped with nozzles that produce solid stream, fog stream, or broken stream water patterns. A solid stream produces a compact stream with little shower or spray, such that the stream is able to achieve greater penetration and reach than would other stream types. Nozzles used to produce solid-streams are generally designed so that the nozzle tapers to an aperture or opening at the nozzle outlet. In addition, solid-stream nozzles usually have a smoothbore cylindrical shape to achieve the desired circular cross-sectional shape and reach of the stream. The stream can be adjusted by increasing or decreasing the velocity of the incoming water flow and/or the diameter of the nozzle outlet.

A fog stream is composed of fine water droplets in either a shower or spray, and the pattern is generally adjustable. The fog stream has less velocity, reach, and penetration than that of the solid stream, but achieves better exposure of the maximum surface area of water for heat absorption. Fog-stream nozzles may be adjusted from either a straight stream (not solid stream) to a wide angle using either a manual or automatic nozzle. For example, a manually adjustable fog-stream nozzle may use a selector ring that allows the user to rotate the ring to adjust the flow rate of the incoming water to the nozzle. Automatically adjustable fog-stream nozzles allow the user to vary the flow rate using a flow-restricting valve, while at the same time maintaining a constant nozzle pressure.

Broken streams are usually used in confined spaces and take their form upon exiting the nozzle. Broken streams are broken into coarsely divided drops, which achieve more heat absorption per gallon than a solid stream and have better reach and penetration than a fog stream. Various types of control valves, such as ball, slide, or rotary control, allow a user to adjust the water flow out of the nozzle.

Currently, to adjust a solid-stream nozzle, a firefighter or other user needs to attach or remove tapered sections at the end of a smoothbore nozzle in order to decrease or increase, respectively, the diameter of the nozzle outlet and, thus, the water flow through the nozzle. The current method is cumbersome since the water must first be interrupted before making any adjustments, and the sections must be screwed into one another such that multiple parts are required. However, being able to quickly adjust the flow depending on the circumstances is advantageous, such as when extinguishing fires.

Consequently, there is a need for one-piece nozzles and methods of using the same capable of producing a solid stream and being easily adjustable. More specifically, the nozzles and methods should allow for either manual or automatic adjustment of a solid stream.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1*a* is a side elevation view illustrating an adjustable solid-stream nozzle, according to one embodiment of the present invention;

FIG. 1*b* is a side elevation view of the nozzle of FIG. 1*a* in an expanded state;

FIG. 2*a* is a cross-sectional view of the nozzle of FIG. 1*a;*

FIG. 2*b* is a cross-sectional view of the nozzle of FIG. 1*b* in an expanded state;

Figure 6:
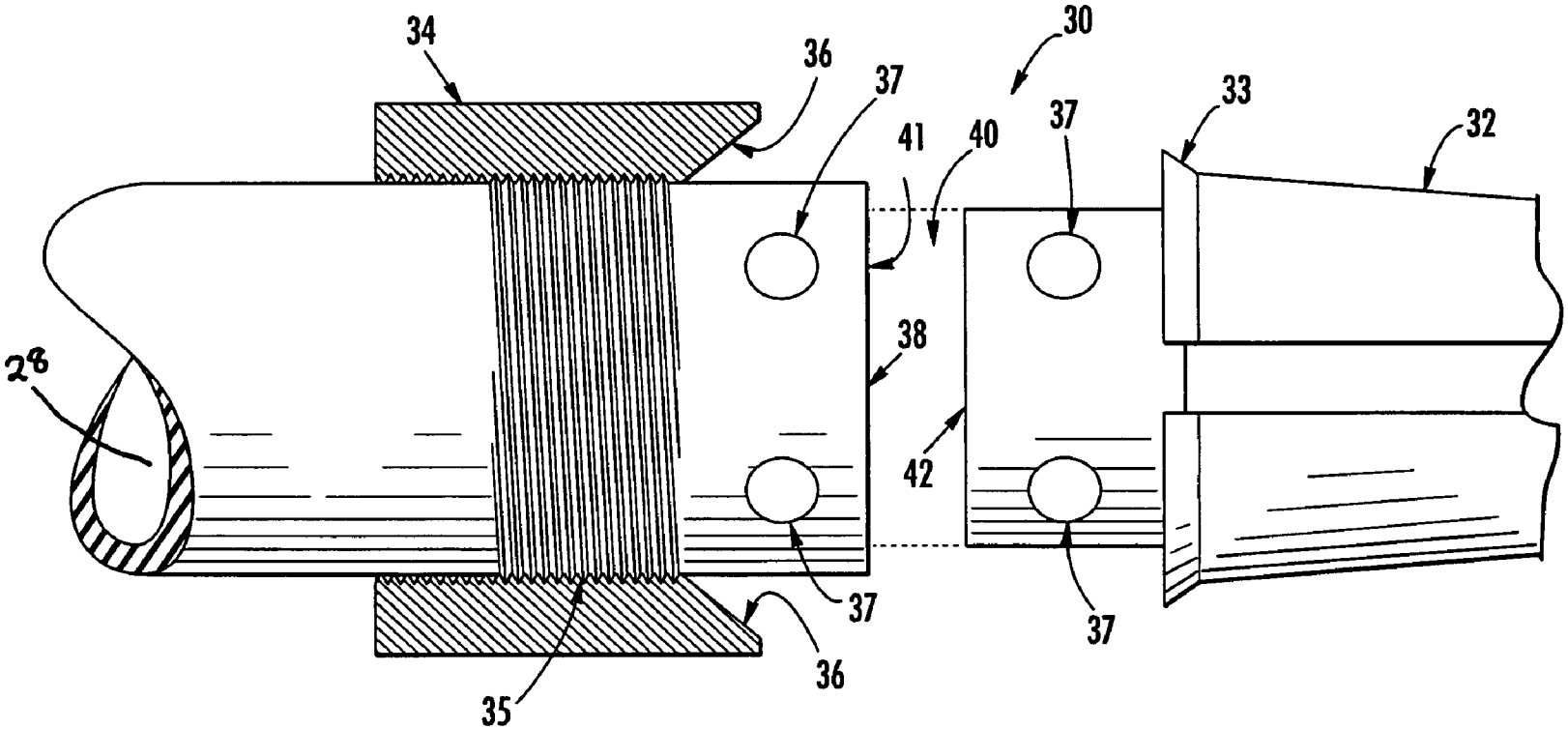
FIG. 6 is an exploded elevation view illustrating an adjustable solid-stream nozzle, according to another embodiment of the present invention.
Figure 7A:
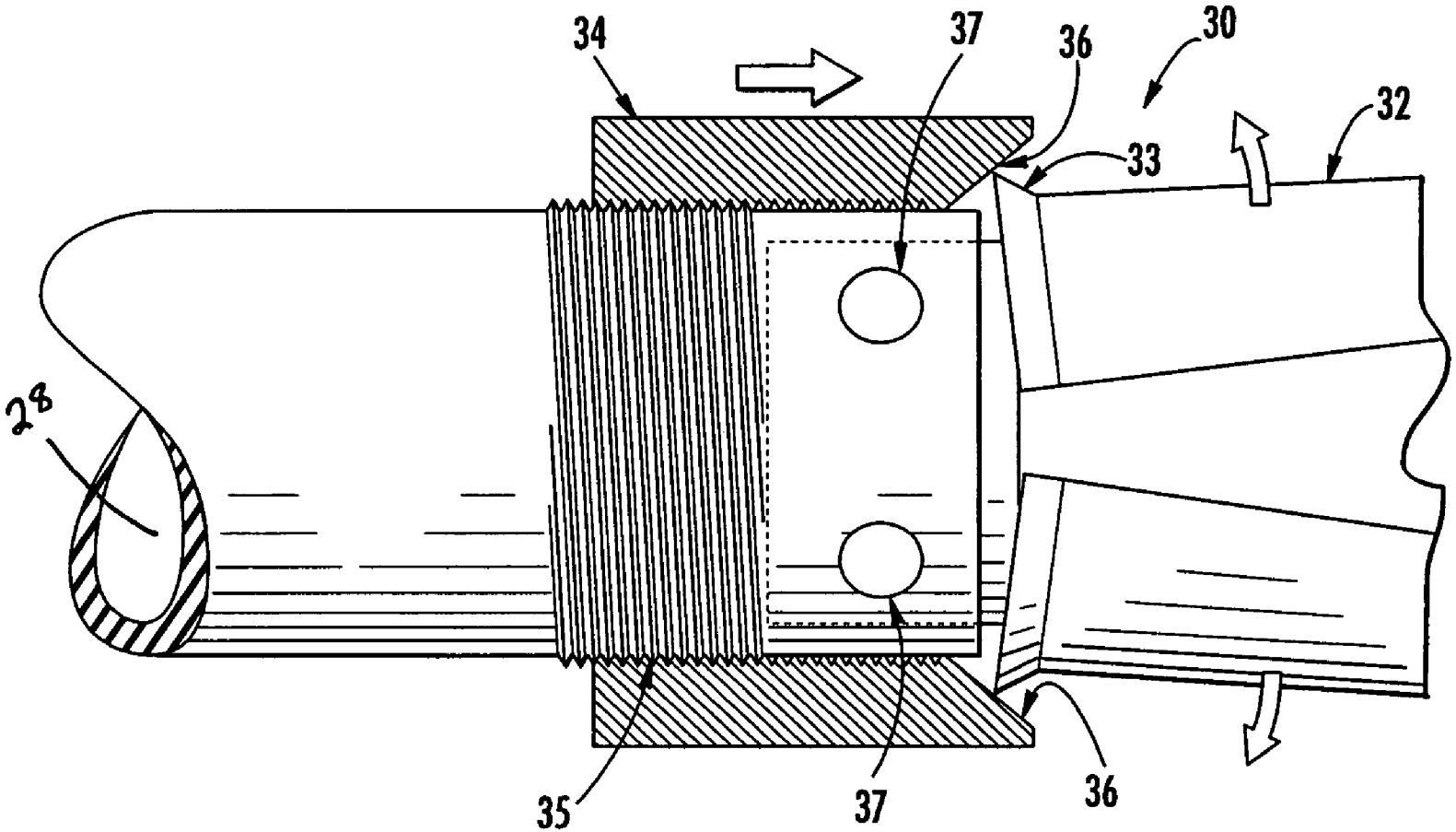
Figure 7B:
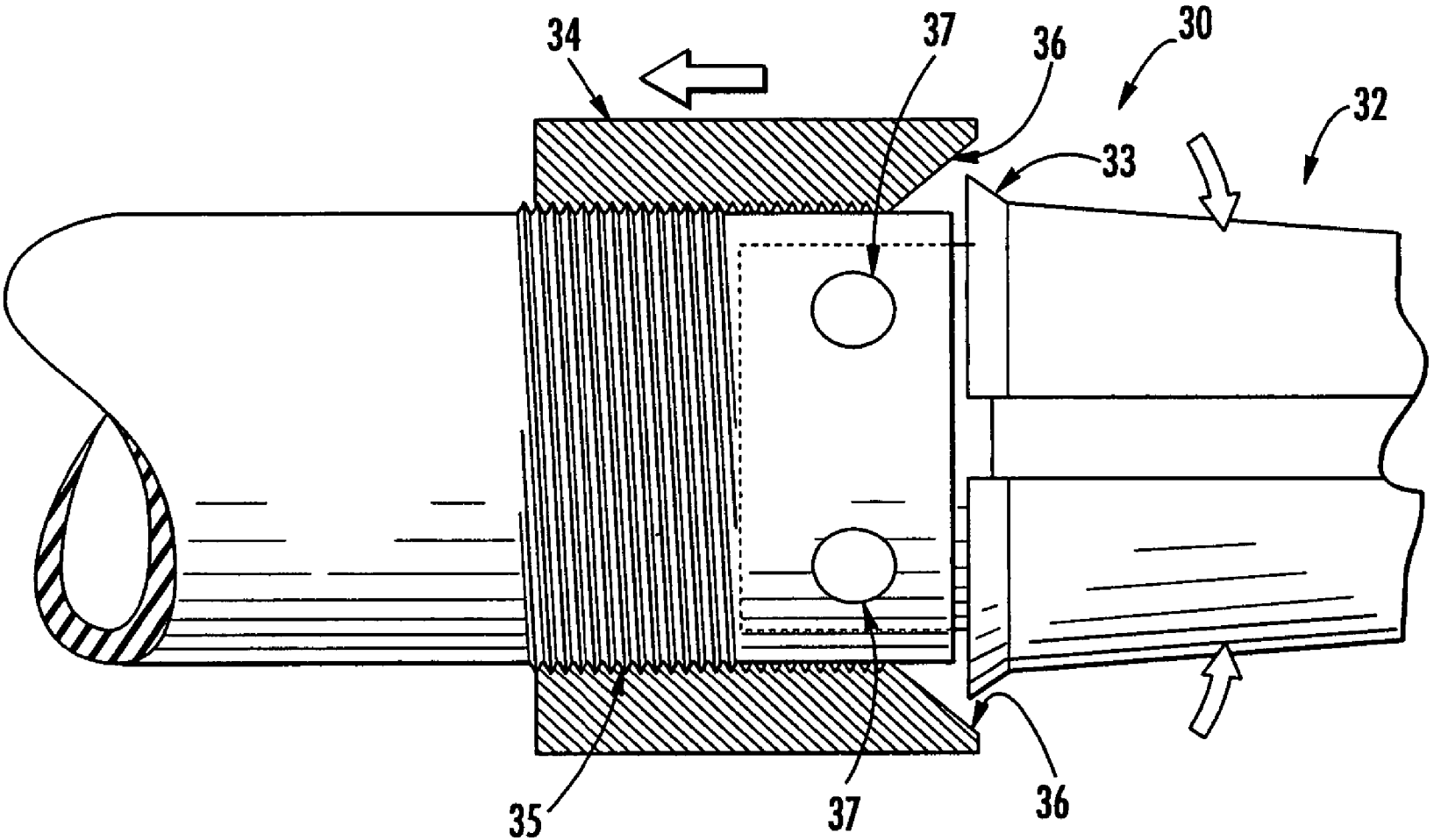
Figure 8:
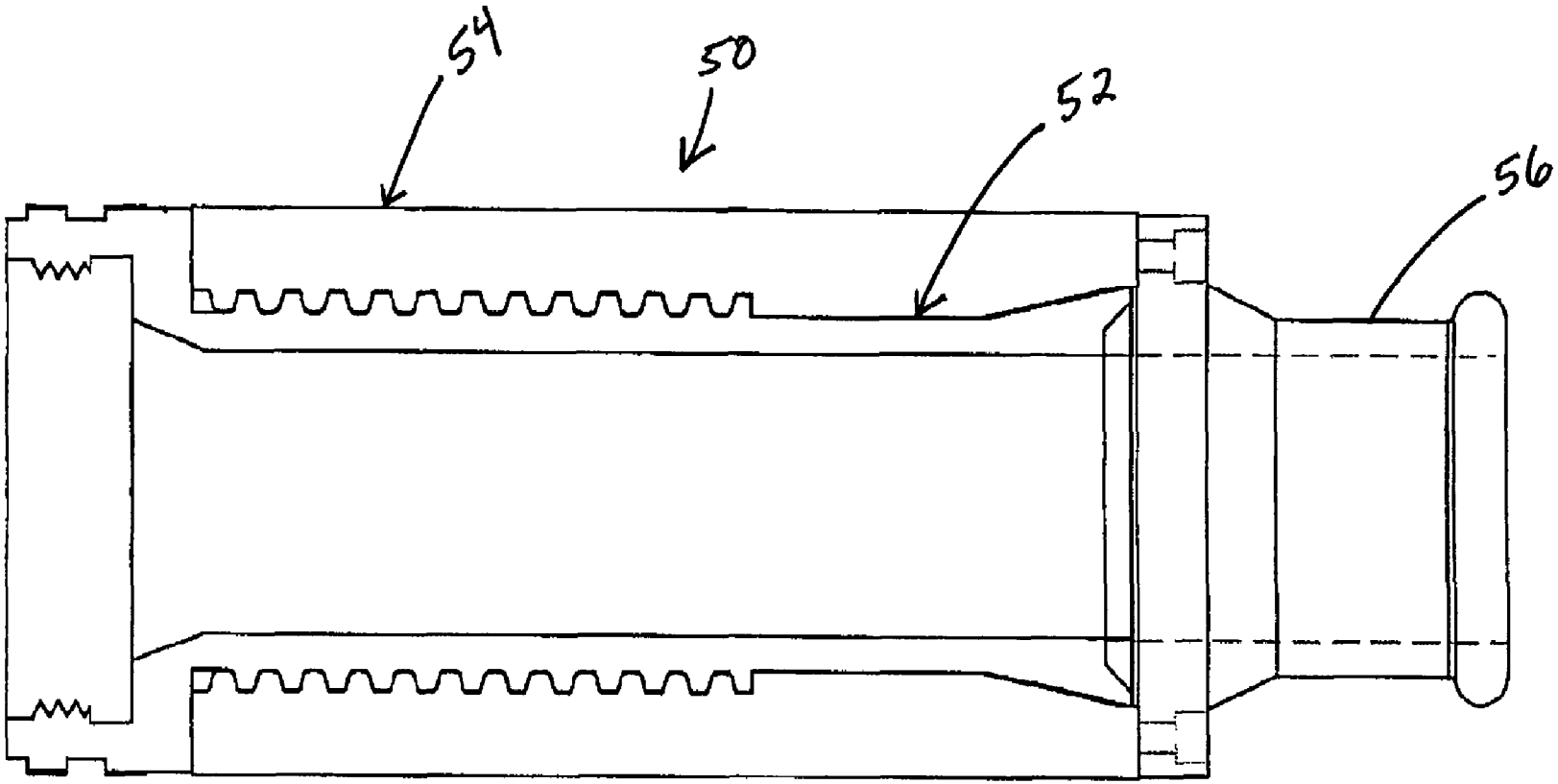
Figure 9A:
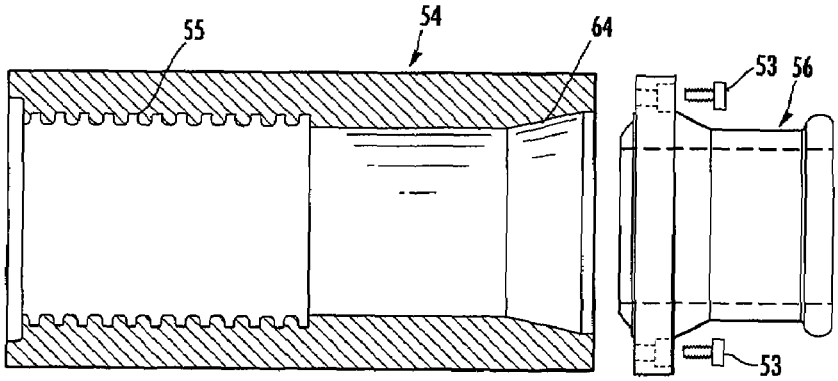
Figure 9B:
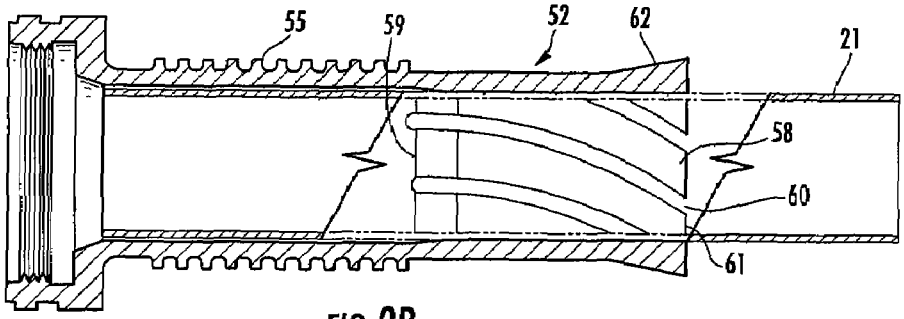

FIG. 7*a* is a side elevation view illustrating the adjustable solid-stream nozzle shown in FIG. 6, illustrating the nozzle when assembled and the vanes expanded;

FIG. 7*b* is a side elevation view illustrating the adjustable solid-stream nozzle shown in FIG. 6, illustrating the nozzle when assembled and the vanes contracted;

FIG. 8 is a cross-sectional view illustrating an adjustable solid-stream nozzle, according to another embodiment of the present invention;

FIG. 9*a* is an exploded cross-sectional view illustrating the nut and nozzle cap of the adjustable solid-stream nozzle shown in FIG. 8; and FIG. 9*b* is a cross-sectional view illustrating the base member of the adjustable solid-stream nozzle shown in FIG. 8.

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 1A:
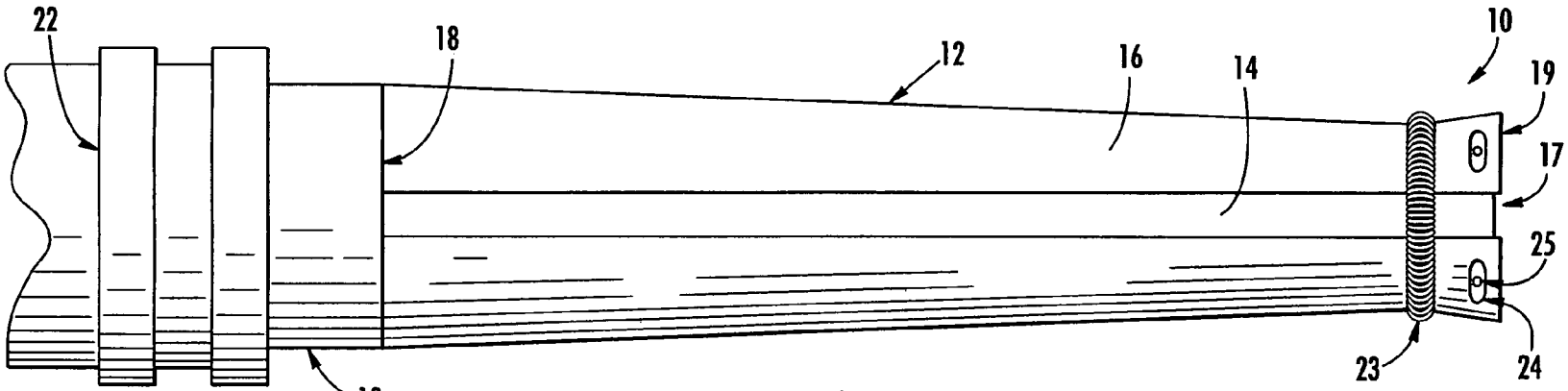

Referring to FIG. 1*a,* there is shown an adjustable solid-stream nozzle, according to one embodiment of the present invention. The nozzle 10 can be used in conjunction with a fire hose or other uses where a solid-stream flow of fluid is desired. Thus, the nozzle 10 is capable of attaching to a hose 22 to permit a sufficient amount of water or other fluid to pass therethrough to produce a stream of fluid at a nozzle outlet 17. The diameter of the nozzle outlet 17 can vary depending on the desired flow rate and usage. According to one embodiment, the diameter of the nozzle outlet 17 is between approximately ¾ inches to approximately 2 inches. For example, a hand-held nozzle could include a nozzle outlet 17 having a diameter of between approximately ¾ inches to approximately 1½ inches, while a larger nozzle that is secured to a mount, such as a truck, could have a nozzle outlet 17 with a diameter of between about 1⅛ inches to about 2 inches. The length of the nozzle 10 can vary depending on the desired flow rate and usage. According to one embodiment, the nozzle 10 has a length of between about 6 inches to about 18 inches. It is understood that the nozzle 10 should not be limited to use with fire hoses, as the nozzle could be used for other applications such as pressure washing or chemical spraying where a solid-stream is needed.

The nozzle 10 includes a base member 13, a liner 21 and a plurality of elongate vanes 12 each having first and second ends 18, 19. The base member 13 has an opening therethrough defining a nozzle inlet. The first ends 18 of the vanes 12 are secured to the base member 13 in a circular configuration so as to define an interior region 11. The second ends 19 of the vanes 12 are operably secured together, as discussed more fully below, so as to define an expandable nozzle outlet 17. The number of vanes 12 can vary depending upon the usage of the nozzle 10 and the desired flow rate and diameter of the solid-stream from the nozzle outlet 17, but at least two vanes will be used. A durable and expandable liner 21 extends from the nozzle inlet to the nozzle outlet 17 within the interior region 11 defined by the vanes 12. The liner 21 is structured to direct a fluid from the nozzle inlet to the nozzle outlet 17. Advantageously, the vanes 12 are biased towards the liner 21, as discussed more fully below, to thereby support the liner and control the flow of the fluid therethrough, thereby eliminating the need to add sections to the end of the nozzle outlet to control the fluid stream at the nozzle outlet.

Figure 2A:
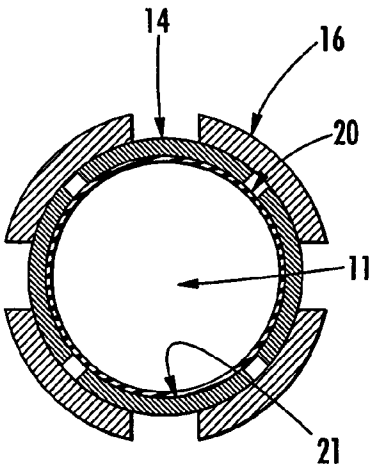

According to one embodiment, as illustrated in FIGS. 1*a* and 2*a,* the nozzle 10 comprises eight vanes 12. FIG. 2*a* illustrates that the vanes 12 are arranged in two layers in which there are four outer vanes 16 and four inner vanes 14. Each outer vane 16 is positioned adjacent to and supports two inner vanes 14. The inner vanes 14 are radially spaced to form small gaps 20, while the outer vanes 16 are radially spaced to cover the small gaps created by the spacing of the inner vanes. The overlapping of the outer vanes 16 and inner vanes 14 provides support to the liner 21. The vanes 12 are made of resilient, chemically inert materials, such as brass, stainless steel, plastic or a composite or cast material. The dimensions and materials of the vanes 12, including the cross-sectional thickness could be modified to achieve various nozzle outlet 17 diameters, as well as to adjust the durability of the nozzle 10 or to increase or decrease the weight of the nozzle. Preferably, the vanes 12 are fabricated of material capable of supporting water pressure up to several hundred pounds.

The base member 13 of the nozzle 10 is structured to receive many different configurations of vanes 12. The base member 13 is constructed of resilient, chemically inert metal or metal alloy, such as brass or stainless steel. The aperture (or nozzle inlet) in the base member 13 is preferably threaded at least in part so as to receive the threaded male end of a hose 22 that provides water to the nozzle 10. The vanes 12 can be connected to the base member 13 of the nozzle 10 using any number of techniques. For example, the inner 14 and outer 16 vanes could be attached using hinges, wherein the hinges are attached to both the base member 13 of the nozzle 10 and the vanes 12 to allow the vanes to pivot. In addition, a coupling (not shown) could be used to connect the vanes 12 to the base member 13 of the nozzle, such that the vanes are inserted within the coupling with sufficient clearance to allow for relative movement of the vanes as the liner 21 expands or contracts. Further, the vanes 12 could be integrally formed or welded to the base member 13 of the nozzle 10, wherein the vanes are formed from a material with a stiffness capable of permitting flexing of the vanes as the liner 21 expands or contracts. The vanes 12 could also be inserted within slots defined in the base member 13 of the nozzle 10 that allow the vanes to pivot while remaining within the slots. In yet another alternative, the vanes 12 could be attached to the base member 13 using fasteners. It is thus understood that many other techniques could be used to allow the vanes 12 to pivot at the base member 13 of the nozzle 10 as the liner 21 expands or contracts.

The liner 21 is also attached to the base member 13 of the nozzle 10 using various techniques. For example, fasteners could be used to secure the liner 21 to the base member 13 of the nozzle 10, or the liner could slip into a groove formed by the base member. Alternatively, a gasket could be used to secure the liner 21 to the base member 13. It is understood that many other techniques could be used to secure the liner 21 to the base member 13 of the nozzle 10. Referring to the embodiment illustrated in FIG. 1*a,* the liner 21 preferably has sufficient length to extend through the interior region 11, and in certain embodiments the liner may fold back over onto the exterior of the outer vanes 16 at the nozzle outlet 17. The liner 21 is constructed of flexible material, such as silicone rubber, so that the liner may expand or contract, as well as form a watertight seal with the vanes 12 and base member 13. In other embodiments, the liner 21 is constructed of a thin flexible metal, such as aluminum. In any event, the materials comprising the liner 21 must be capable of withstanding water pressure up to several hundred pounds.

Figure 2B:
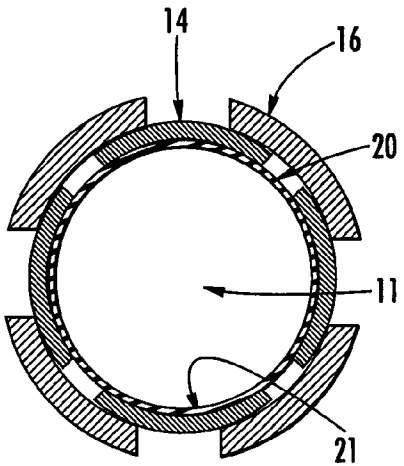

As illustrated in FIGS. 1*a* and 2*b,* a tension spring 23 is positioned near the nozzle outlet. The tension spring 23 acts to bias the vanes 12 towards the liner 21 to thereby resist excessive expansion of the vanes, as well as to provide for smooth expansion and contraction of the liner as the fluid pressure is adjusted. The tension spring 23 preferably has a spring constant capable of resisting sufficient water pressure to maintain a constant nozzle outlet 17 diameter while the fluid pressure remains constant within the liner 21. Similarly, the spring constant should permit adequate flexibility of the vanes 12 to allow the vanes to adjust as the liner 21 expands or contracts with varying fluid pressure.

Figure 1B:
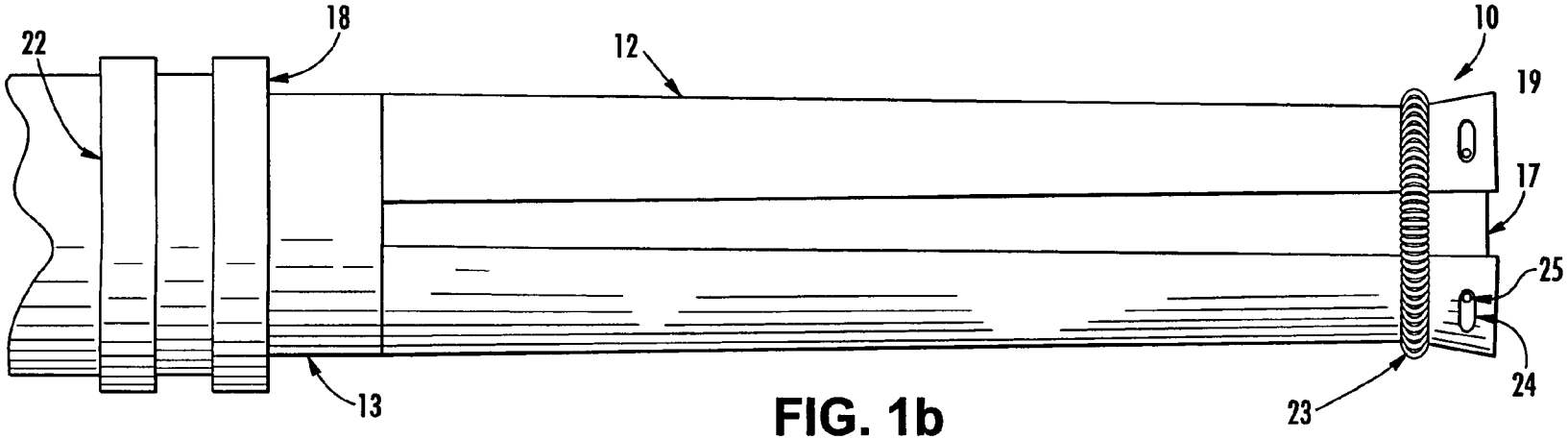

The outer vanes 16 may optionally include slots 24 defined near the second ends 19 of the outer vanes 16. The inner vanes may include pins or other protuberances 25 extending outwardly from the inner vanes 14 that may engage respective slots 24. Thus, the pins 25 are capable of sliding within the slots 24 as the outer diameter of the nozzle outlet 17 is adjusted. As shown in FIG. 1*b,* as the nozzle outlet 17 expands, each of the pins 25 will eventually engage an outer edge of each of the slots 24 to prevent the vanes 12 from expanding further. Consequently, the slots 24 and pins 25 are capable of preventing the nozzle outlet 17 from expanding beyond a predetermined diameter. Different lengths of slots 24 could thus be employed for different nozzle outlet 17 diameters, and the pins 25 could similarly be any dimension to accommodate various slots. Further, it is understood that the pins 25 could extend inwardly from the outer vanes 16 and engage slots 24 defined on an exterior surface of the interior vanes 14.

Figure 5:
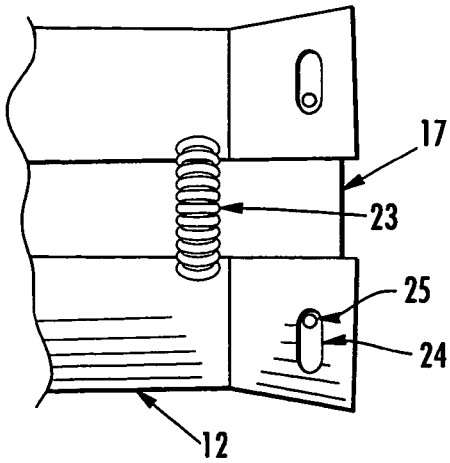
FIG. 5 is a partial side elevation view of an adjustable solid-stream nozzle illustrating a tension spring, according to one embodiment of the present invention.

The tension spring 23 is positioned near the nozzle outlet 17 on the exterior of the outer vanes 16 to prevent interruption of the solid-flow stream exiting the opening 11. As such, one tension spring 23 or multiple tension springs could be used to achieve the desired tension at the nozzle outlet when adjusting the fluid pressure within the liner 21 to change the nozzle outlet 17 diameter. As shown in FIG. 1*a,* the tension spring 23 could be a single spring that is positioned around the exterior of the outer vanes 16. Alternatively, as shown in FIG. 5, multiple tension springs 23 connecting adjacent pairs of outer vanes 16 could be used, wherein each outer vane has eyelets mounted thereon or defines apertures so that the tension springs can be attached. In yet another embodiment (not shown), the tension springs 23 illustrated in FIG. 5 could be secured to the exterior of adjacent pairs of inner vanes 14 so that the springs extend over the exterior of corresponding outer vanes 16.

The vanes 12 are designed such that as the fluid pressure is adjusted within the liner 21, the vanes and liner will either contract or expand in conjunction with the tension spring 23 secured near the nozzle outlet 17. As the fluid pressure increases, the tension spring or springs 23 expand radially allowing the vanes 12 and liner 21 to expand radially as shown in FIGS. 1*b* and 2*b,* thereby increasing the diameter of the nozzle outlet 17 and the diameter of the fluid stream. Conversely, as the fluid pressure is decreased, the tension spring or springs 23 contract radially causing the vanes 12 and liner 21 to contract radially, thereby decreasing the diameter of the nozzle outlet 17 and the diameter of the fluid stream. The vanes 12 act to support the liner 21 and prevent the liner from expanding excessively.

Figure 3:
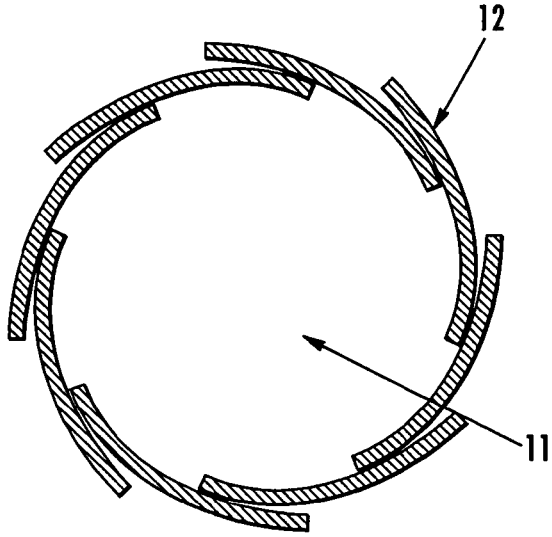
FIG. 3 is a cross-sectional view illustrating an adjustable solid-stream nozzle, according to another embodiment of the present invention.
Figure 4:
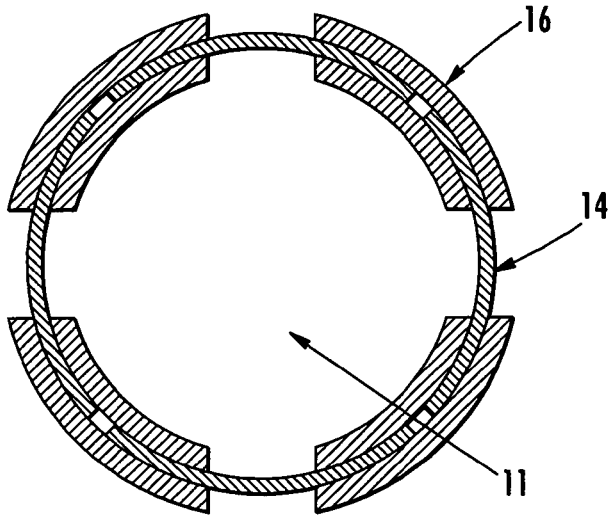
FIG. 4 is a cross-sectional view illustrating an adjustable solid-stream nozzle, according to another embodiment of the present invention.

Referring to FIGS. 3 and 4, there are shown other embodiments of the adjustable pressure nozzle. FIG. 3 illustrates an embodiment wherein the vanes 12 are overlapping and capable of expanding or contracting in response to changing fluid pressure. Each vane 12 overlaps the adjacent vanes to define an interior region 11 structured to receive the liner 21. Additionally, FIG. 4 illustrates an embodiment of the nozzle 10 comprising two sets of vanes 12 that are interlocking, as opposed to overlapping, but are also adjustable and capable of producing a solid stream. The interlocking vanes 12 are configured such that the inner vane 14 is at least partially inserted within a slot in each adjacent outer vane 16 to define an interior region 11 structured to receive the liner 18. Thus, the inner vanes 14 are capable of sliding within the slots of the outer vanes 16 as fluid pressure is adjusted.

According to another embodiment, as illustrated in FIG. 6, the nozzle 30 comprises a base member 40 that includes first 41 and second 42 portions. The first portion 41 of the base member 40 includes a nut 34. The nut 34 is threadably attached to the first portion 41 of the base member 40 via threads 35 so that the nut may be adjusted at least partially along the length of the first portion, as discussed more fully below. The nut 34 is preferably knurled to provide grip for adjustment, but the nut could be any suitable nut that may thread on the first portion 41 of the base member 40. The first portion 41 of the base member 40 has an aperture 28 therethrough defining a nozzle inlet. The aperture 28 of the first portion 41 of the base member 40 is structured to receive the second portion 42 of the base member, as illustrated by the dashed lines in FIG. 6. The second portion 42 of the base member 40 can be secured to the first portion 41 of the base member using fasteners, such as set screws, inserted through corresponding apertures 37 defined by the first and second portions of the base member. It is to be understood that the first 41 and second 42 portions of the base member 40 could be attached in many different ways while still providing a fluid-tight seal. For example, the first 41 and second 42 portions of the base member 40 could be integrally formed or press fitted together. The end of the first portion 41 of the base member 40 distal from the second portion 42 of the base member preferably includes threads (not shown) that are structured to receive mating threads on the male end of a hose.

As illustrated in FIG. 6, the vanes 32 include first ends 33 that are flared outwardly from the second portion 42 of the base member 40. The flared first ends 33 of the vanes 32 are pivotally attached to the second portion 42 of the base member 40 using hinges or the like (not shown). The nut 34 includes a tapered portion 36 that is structured to cooperate with the flared first ends 33 of the vanes 32 as follows. As shown in FIG. 7*a,* as the nut 34 is rotated about the first portion 41 of the base member 40 so that the nut moves towards the vanes 32, the tapered portion 36 causes the flared first ends 33 of the vanes to pivot toward the base member. As the flared first ends 33 of the vanes 32 pivot toward the base member 33, the second ends of the vanes (not shown), which (as described above) are biased towards the liner 18 at the nozzle outlet by the tension spring or springs 23, cause the tension spring or springs to expand radially thereby increasing the diameter of the nozzle outlet and the diameter of the fluid stream. Conversely, as shown in FIG. 7*b,* as the nut 34 is rotated about the first portion 41 of the base member 40 so that the nut moves away from the vanes 32, the flared first ends 33 of the vanes pivot along the tapered portion 36 away from the base member due to the biasing force exerted by the tension spring or springs 23. As the flared first ends 33 of the vanes 32 pivot away from the base member 33, the biasing force exerted by the tension spring or springs 23 at the nozzle outlet causes the second ends of the vanes 23 to contract radially thereby decreasing the diameter of the nozzle outlet and the diameter of the fluid stream.

Another embodiment of the present invention is shown in FIGS. 8 and 9. The nozzle 50 includes a base member 52 and a nut 54 threadably attached to the base member. A nozzle cap 56 is attached to the nut 54 to define a nozzle outlet. A liner (not shown) (such as a liner made of thin aluminum or another metal) can extend substantially through the interior of the base member 52 and, in certain embodiments, the nozzle cap 56. The nozzle cap 56 is attached to the nut 54 with fasteners 53 or the like such that the nut and nozzle cap are secured together capable of rotating in unison. The nozzle cap 56 is utilized to provide a transition between the base member 52 and the outlet of the nozzle 50 for fluid flowing therethrough.

Rotation of the either the base member 52 or the nut 54 causes the diameter of the fluid stream to adjust, thereby affecting the amount of fluid exiting the nozzle cap 56 and, thus, the nozzle outlet. More specifically, FIGS. 9*a* and 9*b* illustrate that each of the base member 52 and nut 54 includes threads 55 that mate with one another. In addition, vanes 58 are defined integrally with the base member 52. FIG. 9*b* shows that the vanes 58 are fluted and extend in a generally spiral and circumferential configuration. Openings or gaps 60 are defined between each vane 58 to provide flexibility. As the vanes expand or contract, pressure is applied to the liner to thereby expand or contract the liner. The gaps 60 can be formed completely through the wall of the base member 52.

At the second end 61 of the vanes 58, the base member 52 defines a flared end 62. Similarly, the nut 54 defines a flared or tapered portion 64 corresponding to the flared end 62 of the base member 52. As described above, due to the flexibility of the vanes 58, rotation of the nut 54 causes the flared end 62 and tapered portion 64 to bias against one another thereby causing the vanes 58 to be either biased towards or away from the liner, which in turn results in the diameter of the liner contracting or expanding, respectively, depending on the direction of rotation. For example, with reference to FIG. 8, rotation of the nut 54 from left to right causes the second ends 61 of the vanes 58 to contract and became biased towards the liner, while rotation in the opposite direction causes the second ends to expand and become biased away from (i.e., move away from) the liner. It is understood that the base member 52 could be rotated to achieve the same contraction or expansion of the outlet of the nozzle 50.

It is understood that the vanes 58 shown and described with respect to FIGS. 8 and 9 should not be limiting. For instance, the gaps 60 could be of various sizes and configurations to impart various degrees of flexibility to the vanes 58. In addition, the vanes 58 can be of various lengths relative to the overall length of the base member 52. Furthermore, the flared end 62 and tapered portion 64 could extend at different angles and lengths to provide varying amounts of expansion and contraction of the outlet of the nozzle 50, and the number of the threads 55 could also or alternatively be modified for a desired amount of adjustment.

Advantageously, the adjustable pressure nozzles 10, 30, and 50 of the present invention allow for adjusting the diameter of the flow of a solid stream of fluid through the nozzle outlet quickly and accurately without having to interrupt the flow of fluid to add or remove sections from the nozzle outlet.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An adjustable nozzle for directing a solid-stream of fluid, comprising:

an inner base member having an aperture therethrough defining a nozzle inlet, wherein said inner base member comprises a first portion and a second portion, said first portion being adjacent to said second portion and having an exterior defining a threaded surface, said second portion comprising a plurality of elongate vanes each having first and second ends, each of said second ends of each of said vanes corresponding to an adjustable nozzle outlet, the outer surface of each of said second ends of each of said vanes defines a raised portion that tapers in thickness from said second end towards said first end, said vanes extending from said first ends to said adjustable nozzle outlet so as to form an interior region therebetween;

a cylindrical liner extending at least partially from said nozzle inlet to said nozzle outlet and within said interior region, said liner being structured to direct a fluid from said nozzle inlet towards said nozzle outlet;

an outer member comprising a threaded portion and a non-threaded portion defined adjacent to said threaded portion, wherein said non-threaded portion comprises a frustoconical section, and wherein said threaded portion of said outer member is engaged with said threaded surface of said inner base member such that rotation of said outer member relative to said inner base member results in biasing of said raised portion of said vanes and said frustoconical section against one another to adjust a diameter of said interior region and said cylindrical liner; and wherein said vanes define a first state in which said raised portion of said vanes and said frustoconical section are not biased against one another and a second state in which said raised portion of said vanes and said frustoconical section are baised against one another, and wherein each of said vanes defines in both said first state and said second state curvilinear lateral sides such that each of said vanes has an arcuate configuration as said vanes extend from said first end to said second end.

2. A nozzle according to claim 1 wherein said first ends of each of said vanes are integrally formed with said first portion.

3. A nozzle according to claim 1 further comprising an opening defined between each of said vanes.

4. A nozzle according to claim 1, further comprising a nozzle cap attached to said outer member adjacent to said second ends.

5. A nozzle according to claim 4, wherein said cylindrical liner extends from said nozzle inlet to said nozzle outlet and through said nozzle cap.

6. A nozzle according to claim 1, wherein said threaded surface is defined approximately midway along a length of said inner base member.

7. A nozzle according to claim 1, wherein said threaded portion is defined approximately midway along a length of said outer member.

8. A nozzle according to claim 1, wherein said outer member comprises an interior surface defining said threaded portion.

9. A nozzle according to claim 1, wherein said cylindrical liner comprises aluminum.

10. A method for adjusting a stream of fluid through a nozzle, comprising:

providing a nozzle comprising an outer member and an inner base member, wherein the inner base member comprises a first portion and a second portion, the first portion being adjacent to the second portion and having an exterior defining a threaded surface, the second portion comprising a plurality of elongate vanes each having first and second ends, each of the second ends of each of the vanes corresponding to an adjustable nozzle outlet, the outer surface of each of the second ends of each of the vanes defines a raised portion that tapers in thickness from the second end towards the first end, the vanes extending from the first ends to the adjustable nozzle outlet so as to form an interior region therebetween, and wherein the outer member comprises a threaded portion and a non-threaded portion defined adjacent to the threaded portion, the threaded portion of the outer member engaged with the threaded portion of the inner base member, and the non-threaded portion of the outer member comprising a frustoconical section; wherein the vanes define a first state in which the raised portion of the vanes and the frustoconical section are not biased against one another and a second state in which the raised portion of the vanes and the frustoconical section are baised against one another, and wherein each of the vanes defines in both the first state and the second state curvilinear lateral sides such that each of the vanes has an arcuate configuration as the vanes extend from the first end to the second end;

directing fluid through a nozzle inlet defined by the base member and through a cylindrical liner extending at least partially from the nozzle inlet to the nozzle outlet and within the interior region; and rotating the outer member relative to the inner base member in order to bias the raised portion of the vanes and the frustoconical section against one another to adjust a diameter of the interior region and the cylindrical liner.

11. A method according to claim 10 wherein said rotating step comprises biasing the vanes towards the liner.

12. A method according to claim 10 wherein said rotating step comprises rotating the outer member towards the nozzle outlet so that the nozzle outlet expands.

13. A method according to claim 10 wherein said rotating step comprises rotating the outer member away from the nozzle outlet so that the nozzle outlet contracts.

14. A method according to claim 10 wherein said providing step comprises providing a plurality of vanes having respective first ends integrally formed with the first portion.

* * * * *